US005494322A

United States Patent [19]

Menke

[11] Patent Number: 5,494,322

[45] Date of Patent: Feb. 27, 1996

[54] POWER-ACTUATED MOTOR-VEHICLE DOOR LATCH WITH CHILD-SAFETY CUTOUT

[75] Inventor: Hans Menke, Velbert, Germany

[73] Assignee: Kiekert GmbH & Co. KG, Heiligenhaus, Germany

[21] Appl. No.: 184,250

[22] Filed: Jan. 18, 1994

[30] Foreign Application Priority Data

Jan. 15, 1993 [DE] Germany ..... 43 00 821.6

[51] Int. Cl.[6] ..... E05C 3/16

[52] U.S. Cl. ..... 292/216; 292/201

[58] Field of Search ..... 292/201, 216, 292/336, DIG. 3, DIG. 23, DIG. 65

[56] References Cited

U.S. PATENT DOCUMENTS

| | | | |
|---|---|---|---|
| 3,049,372 | 8/1962 | Pickles | 292/216 |
| 4,487,441 | 12/1984 | Miyamoto et al. | 292/DIG. 65 |
| 5,000,495 | 3/1991 | Wolfgang et al. | 292/216 |

FOREIGN PATENT DOCUMENTS

| | | | |
|---|---|---|---|
| 2403238 | 8/1974 | Germany | 292/216 |
| 2911630C2 | 10/1982 | Germany . | |
| 2911681C2 | 11/1982 | Germany . | |
| 3244049C2 | 2/1986 | Germany . | |
| 3438342C2 | 9/1987 | Germany . | |
| 35918 | 3/1979 | Japan | 292/216 |

*Primary Examiner*—Peter M. Cuomo
*Assistant Examiner*—Tuyet-Phuong Pham
*Attorney, Agent, or Firm*—Herbert Dubno; Andrew Wilford

[57] ABSTRACT

A motor-vehicle door latch has a lock fork engageable with a door bolt and a release pawl engageable with the fork. A lever mechanism connected to the release pawl can operate the release pawl. A locking element pivoted on the housing about an element axis and operatively connected to the lever mechanism is formed with an outwardly open notch and is displaceable for decoupling the lever mechanism from the release pawl in the locked position of the locking element and for coupling the lever mechanism to the release pawl in the unlocked position of the locking element. A cutout lever is pivotable on the housing about a cutout axis and a drive body rotatable about a drive axis parallel to the element and cutout axes has an eccentric pin extending parallel to the axes. The pin is engaged in the notch and is engageable with the cutout lever. An inside handle is permanently connected to an inside latching lever to actuate it, is operatively connected to the cutout lever, and has an end engageable with the mechanism to actuate same only in the normal position of the cutout lever. This inside latching lever is operatively unengageable with the mechanism in the cutout position of the cutout lever. A motor can rotate the drive body and thereby orbit the pin about the drive axis to displace the cutout lever between the cutout and normal positions, and to displace the locking element between the locked and unlocked positions.

3 Claims, 12 Drawing Sheets

FIG. 4a
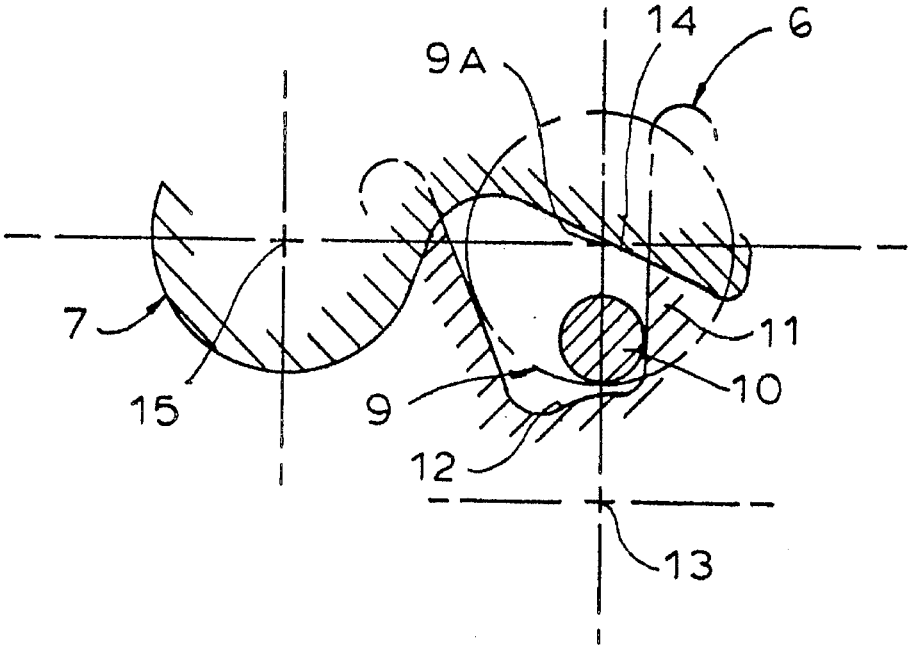
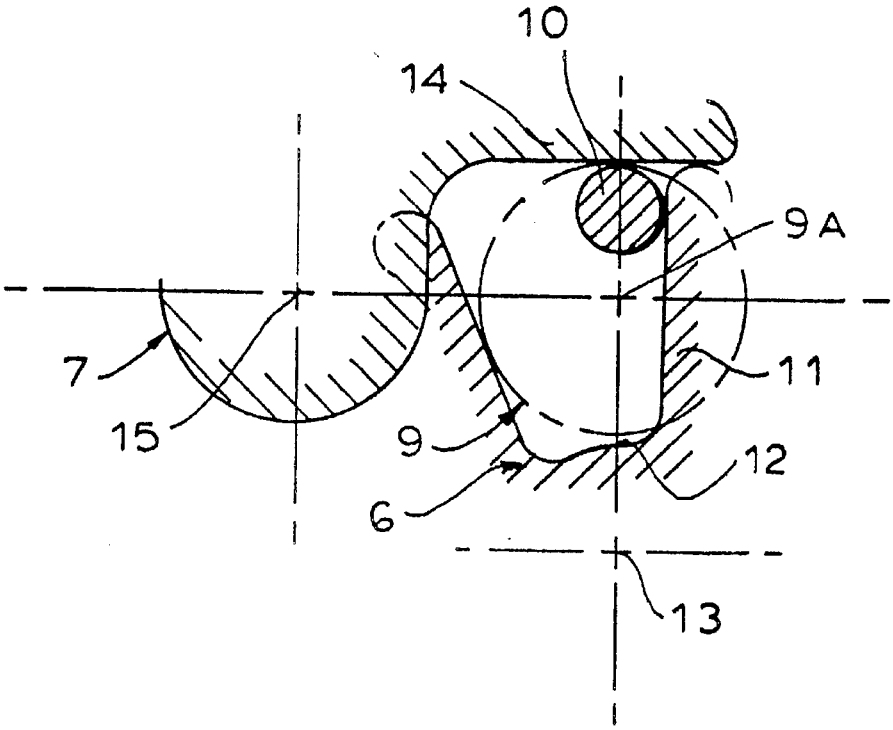
FIG. 4b

FIG. 4c
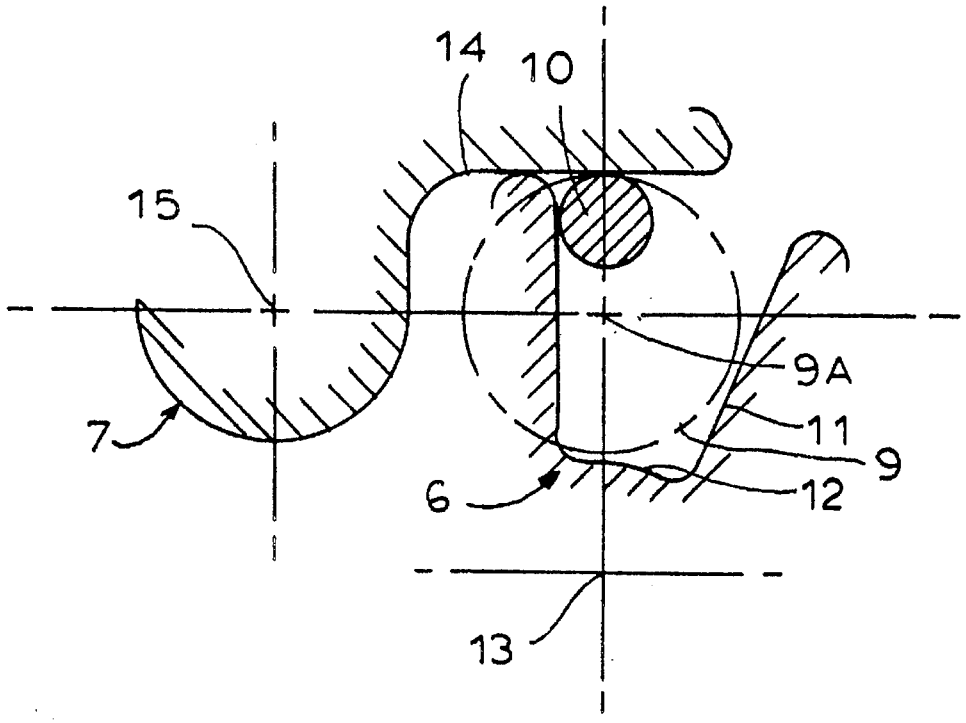
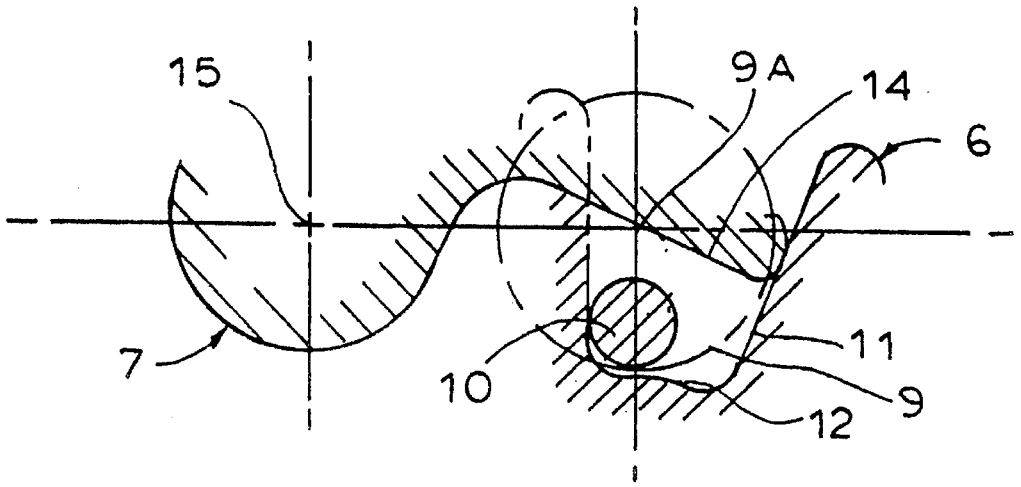
FIG. 4d

POWER-ACTUATED MOTOR-VEHICLE DOOR LATCH WITH CHILD-SAFETY CUTOUT

FIELD OF THE INVENTION

The present invention relates to a motor-vehicle door latch. More particularly this invention concerns such a latch that is power actuated and that has a child-safety cutout.

BACKGROUND OF THE INVENTION

A motor-vehicle door latch normally has a housing, a pivotable lock fork on the housing engageable with a door bolt and pivotable between a locked position engaged around the bolt and retaining it on the housing and an unlocked position permitting the door bolt to move into and out of the housing, a release pawl engageable with the fork and displaceable between a holding position retaining the fork in the locked position and a freeing position out of engagement with the fork and permitting the fork to move into the unlocked position, and a lever mechanism connected to the release pawl and movable between an actuated position displacing the pawl into the freeing position and an unactuated position with the pawl in the holding position Inside and outside handles operable from inside and outside the vehicle are connected to the lever mechanism to operate it and unlatch the door.

Inside and outside lock elements are also connected via a common locking lever to this mechanism and are actuatable to prevent at least the outside handle from operating the lever mechanism. Such an arrangement is also often provided with a power actuator that can displace the locking lever to lock and unlock the door centrally and/or remotely.

To prevent a door, normally a rear-seat door, from being accidentally opened, normally by a child, it has become standard to provide a so-called child-safety or -cutout system. This is typically embodied as an element that is exposed at the edge of the door when the door is open and that can be moved between an on and off position. In the on position the inside door handle is no longer operational.

To further prevent that a door can be opened from inside, for instance by a would-be thief who has broken the window to reach into the vehicle, it is known to provide a so-called antitheft system. This system disables the inside locking and latching elements so that the door cannot be unlocked or unlatched from inside. Such an arrangement can also be actuated by the power actuator. Clearly the antitheft and child-safety systems both have in common that they disable the inside door handle, so that these functions are in fact closely related.

In central lock systems it is not normally necessary to provide locking buttons or elements on the rear-seat doors, as the doors are centrally locked and unlocked from the front seat. To open a locked rear-seat door from inside it is therefore standard to set up the lock so that a first actuation of the inside door handle unlocks the door and a second actuation actually unlatches it. This is an important safety feature in that it prevents a locked door from opening if its handle is accidentally actuated once, but still lets an occupant open up a locked door.

SUMMARY OF THE INVENTION

A motor-vehicle door latch has according to the invention a housing, a lock fork on the housing engageable with a door bolt and pivotable between a locked position engaged around the bolt and retaining it on the housing and an unlocked position permitting the door bolt to move into and out of the housing, and a release pawl engageable with the fork and displaceable between a holding position retaining the fork in the locked position and a freeing position unengageable with the fork and permitting the fork to move into the unlocked position. A lever mechanism connected to the release pawl can move between an actuated position displacing the release pawl into the freeing position and an unactuated position with the release pawl in the holding position. A locking element pivoted on the housing about an element axis and operatively connected to the lever mechanism is formed with an outwardly open notch of predetermined angular width and is displaceable between locked and unlocked positions for decoupling the lever mechanism from the release pawl in the locked position of the locking element and for coupling the lever mechanism to the release pawl in the unlocked position of the locking element. A cutout lever is pivotable on the housing about a cutout axis between a cutout position and a normal position. A drive body rotatable about a drive axis parallel to the element and cutout axes has an eccentric pin extending parallel to the axes and of a diameter equal to at most half of the width of the notch. The pin is engaged in the notch and is engageable with the cutout lever. An inside handle operable from inside the vehicle is permanently connected to an inside latching lever to actuate it, is operatively connected to the cutout lever, and has an end engageable with the mechanism to actuate same only in the normal position of the cutout lever. This inside latching lever is operatively unengageable with the mechanism in the cutout position of the cutout lever. A motor can rotate the drive body and thereby orbit the pin about the drive axis for displacing the cutout lever between the cutout and normal positions, and displace the locking element between the locked and unlocked positions.

Thus with this system a single remotely controlled drive motor in the latch can set the latch in an antitheft or child-safety position with the inner handle disabled. This setting can be effected whether or not the outside handle is operational. This is in distinction to the prior-art antitheft systems which only disable the inside handle when the outside handle is disabled and the child-safety systems which disable the inside handle on a semipermanent basis, that is until a special lever or button on the door edge is reset.

According to this invention the cutout lever and locking element are displaceable between the respective positions independently of each other. Furthermore the locking element, cutout lever, drive body, and inside locking lever are pivotable about respective parallel axes on the housing.

BRIEF DESCRIPTION OF THE DRAWING

The above and other objects, features, and advantages will become more readily apparent from the following description, reference being made to the accompanying drawing in which.

Figure 7:
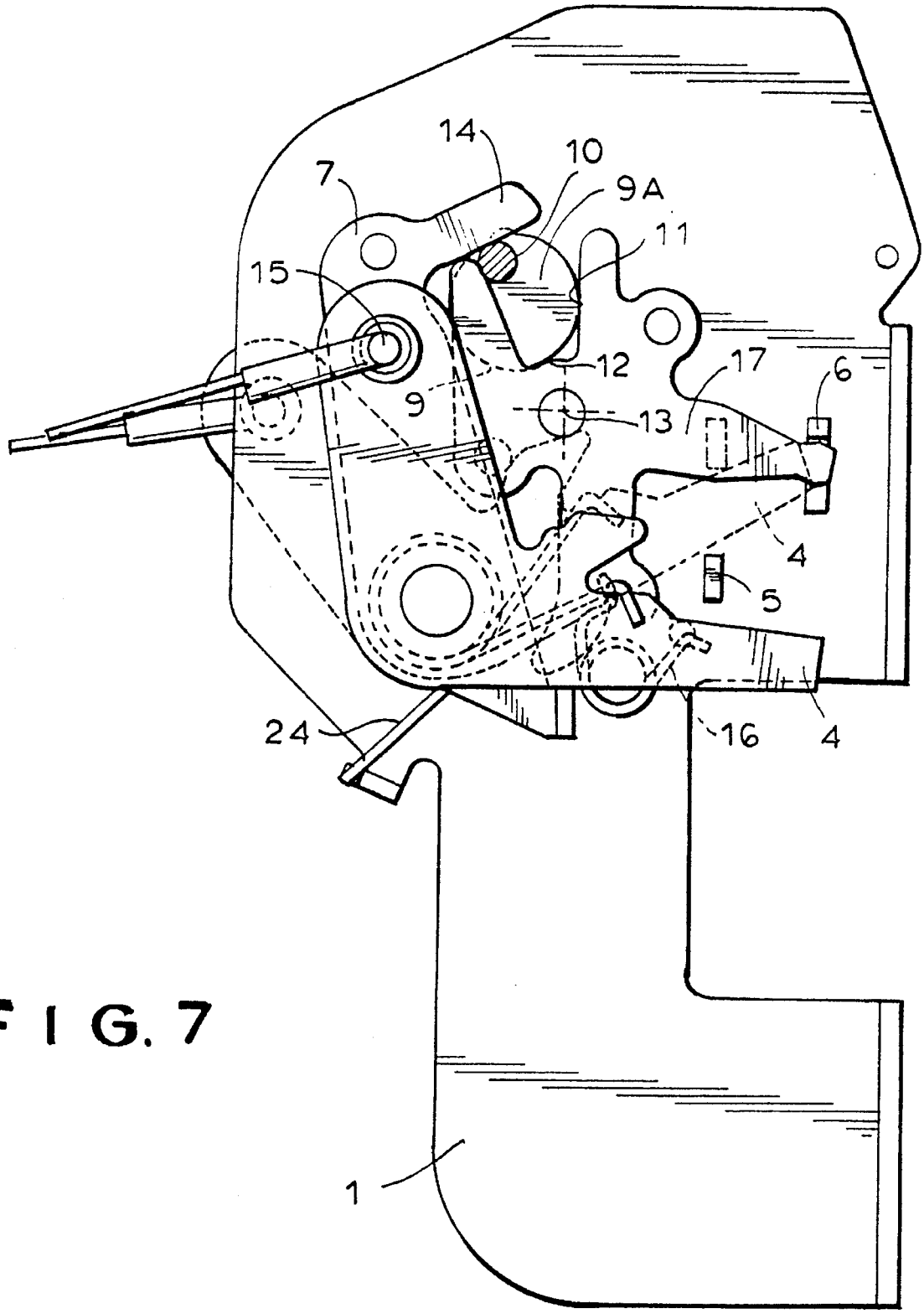
Figure 8:
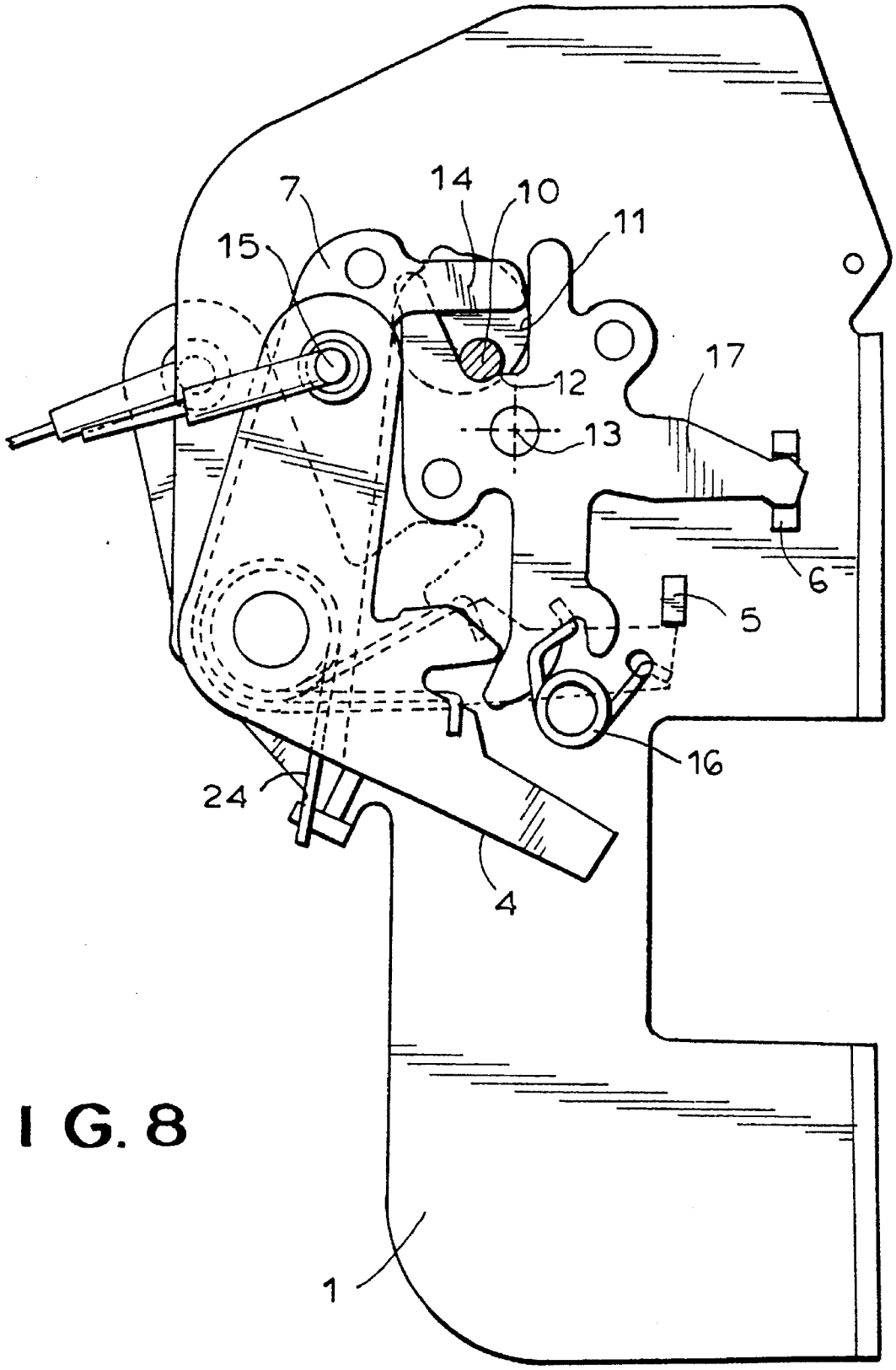
Figure 9:
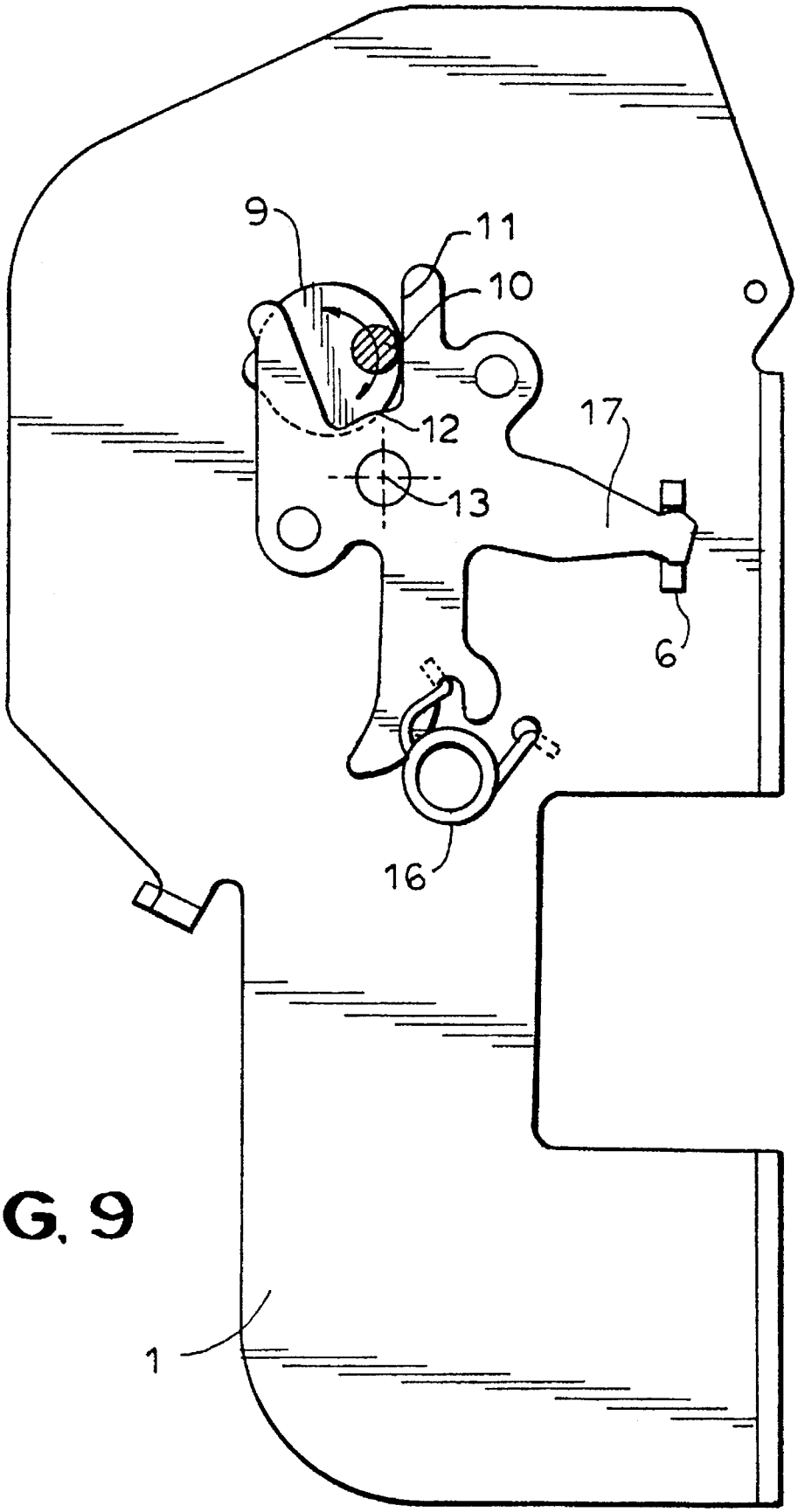
Figure 10:
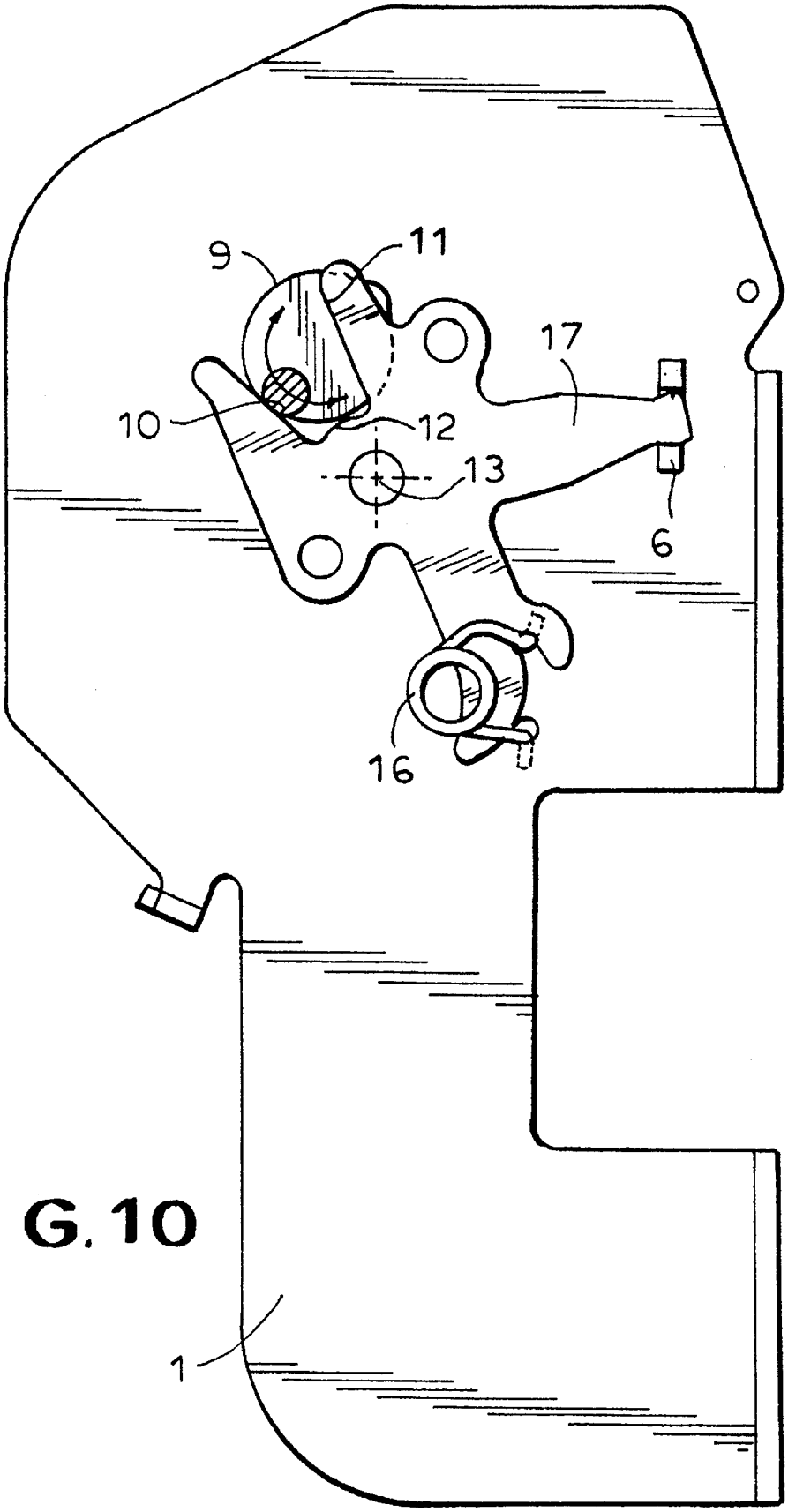

FIG. *4a* is a diagrammatic large-scale view illustrating operation of the power-drive element and the parts immediately associated with it in the position with the inside handle cut out and the door locked;

FIG. 4*b* is a view like FIG. 4*a* but with the inside handle operational and the door locked;

FIG. 4*c* is a view like FIG. 4*a* but with the inside handle operational and the door unlocked;

FIG. 4*d* is a view like FIG. 4*a* but with the inside handle cut out and the door unlocked;

FIGS. 5, 6, 7, and 8 are side views illustrating the power-latch and child-safety systems in the positions of respective FIGS. 4*a*, 4*b*, 4*c*, and 4*d*; and FIGS. 9 and 10 are side views of portions of the structure showing power unlocking and locking of the latch.

SPECIFIC DESCRIPTION

Figure 1:
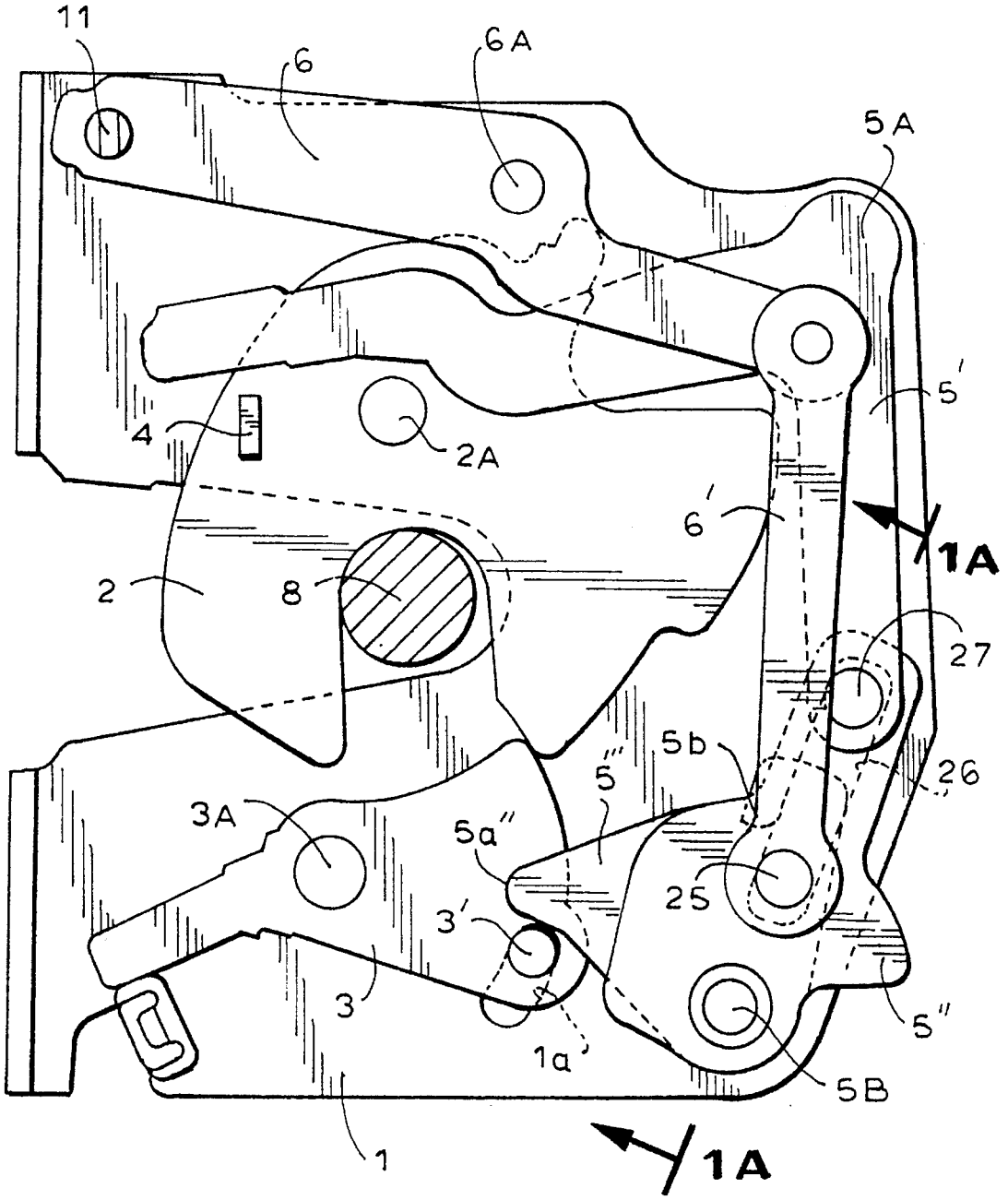
FIG. 1 is a partly diagrammatic side view of elements of the latch in the closed, latched, and locked positions.
Figure 2:
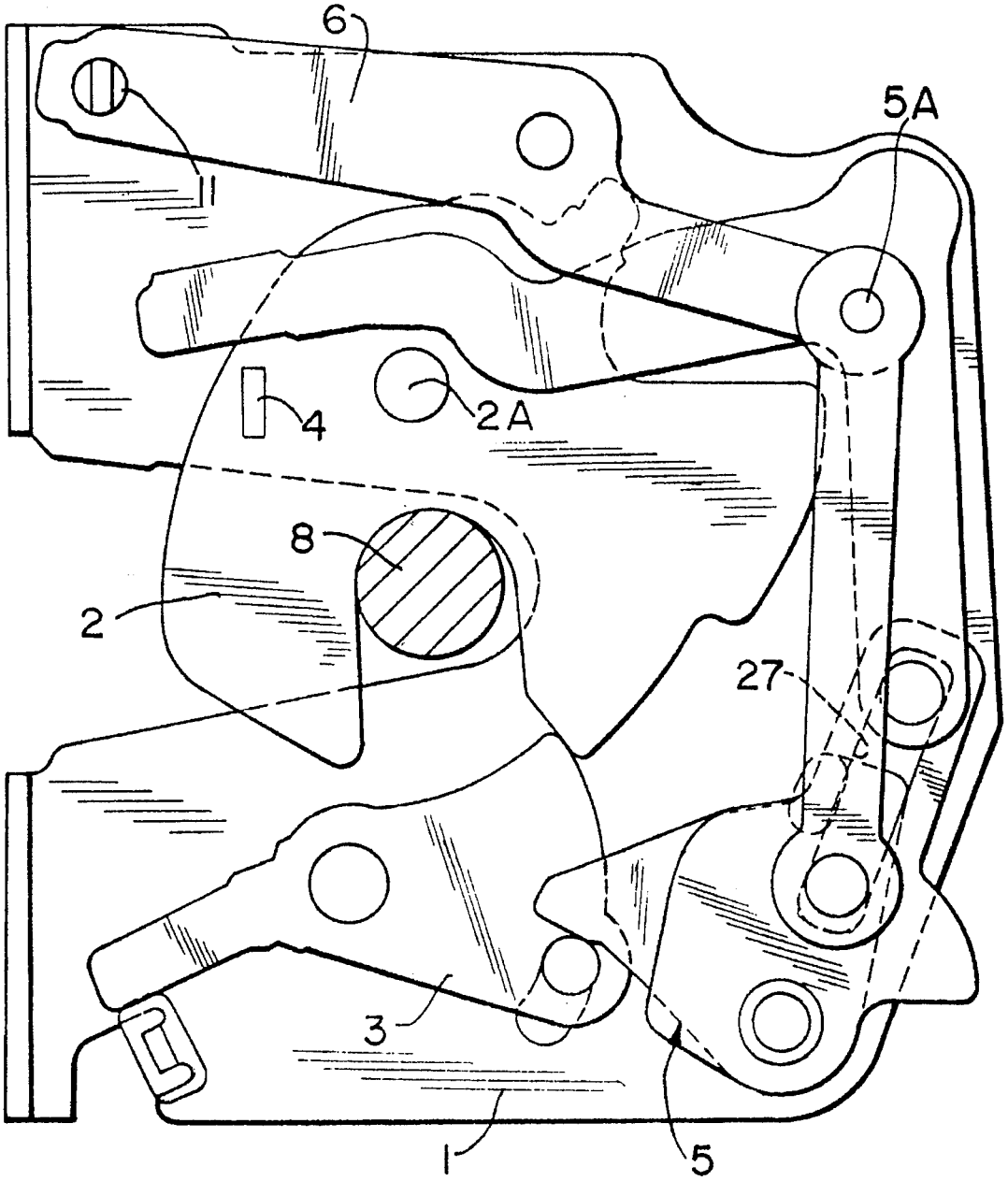
FIG. 2 is a view like FIG. 1 of the latch in the closed, unlocked, and latched positions.
Figure 3:
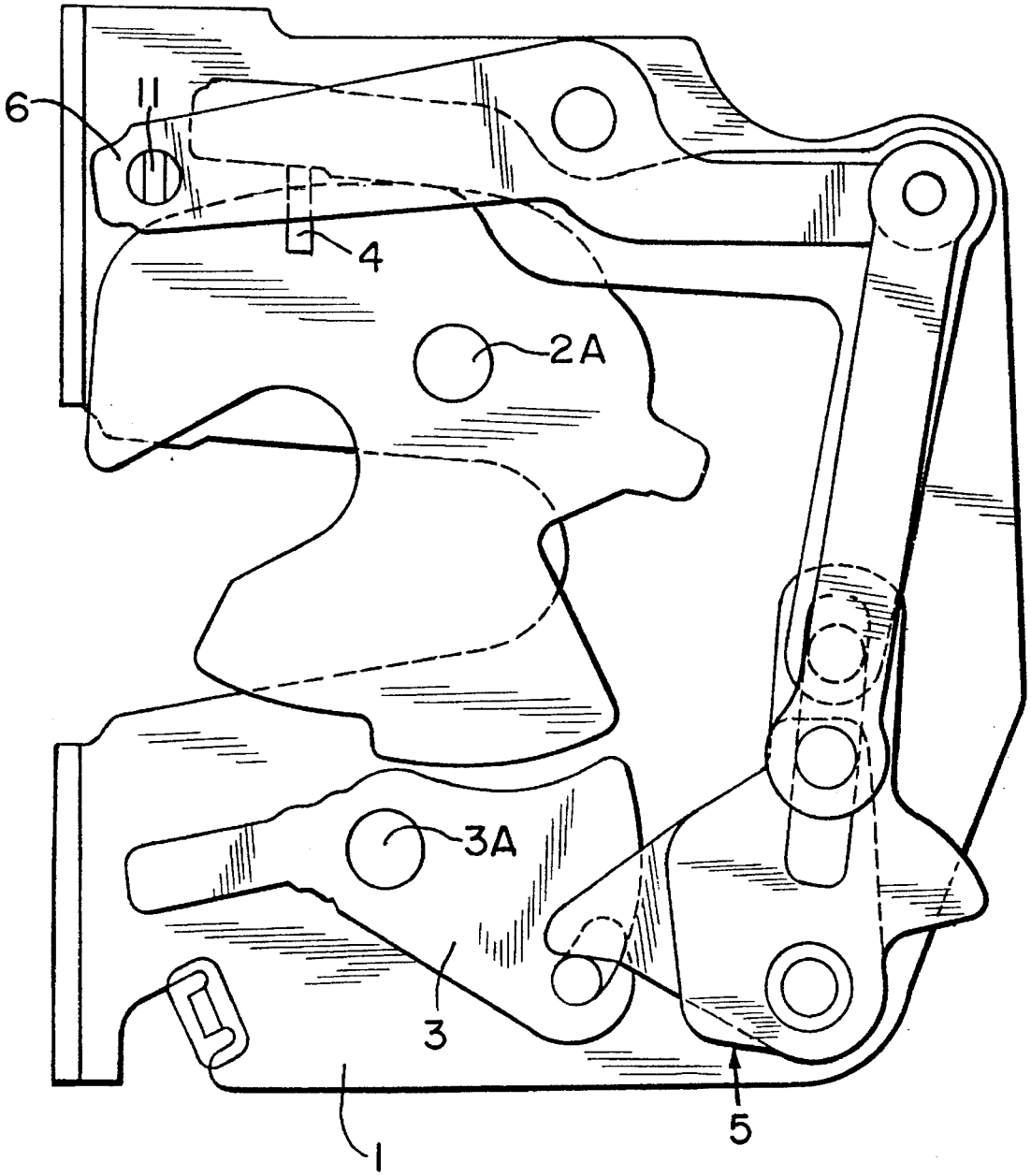
FIG. 3 is another view like FIG. 1 of the latch in the open, unlatched, and unlocked positions.

As seen in FIGS. 1 through 3 a motor-vehicle door latch according to this invention has a housing 1 that is normally mounted on an edge of a door and that is provided with a fork 2 pivotable about a fork axis 2A to engage around and trap a bolt 8 mounted on the unillustrated door post. A pawl 3 pivotable about an axis 3A on the housing 1 can retain the fork 2 in the locked position of FIGS. 1 and 2. A mechanism 5 comprising levers 5', 5", and 5'" pivotable about axes 5A and 5B on the housing 1 is operable to pivot the pawl 3 into the freeing position of FIG. 3 and release the bolt 8. This structure is all standard.

Figure 5:
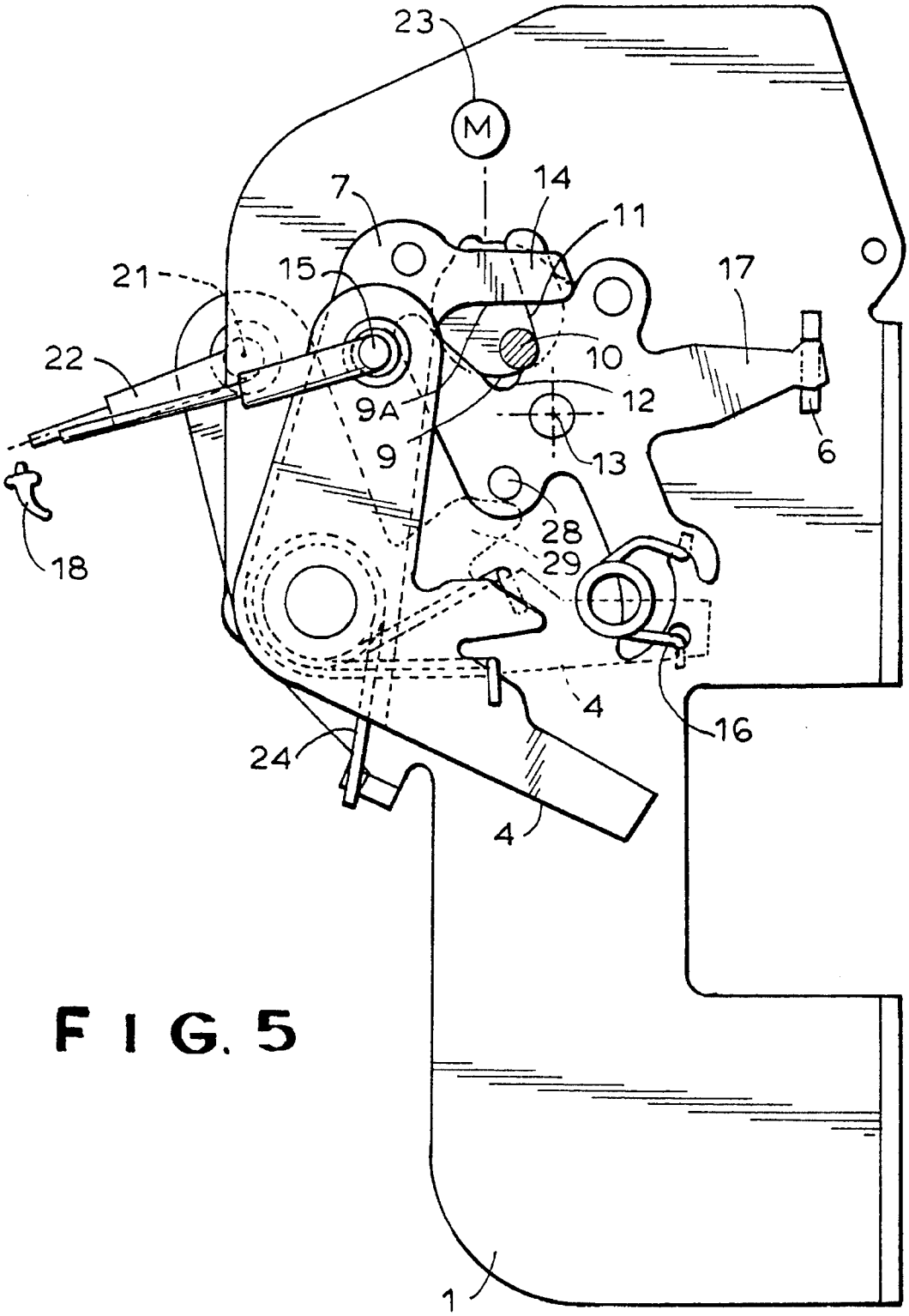

A locking lever 6 operable by an arm 17 of an actuating lever or locking element 11 can decouple the latching mechanism 5 from the release pawl 3 to lock the door by decoupling this mechanism from the handles of the inside and outside door handles 18 and 19 (FIGS. 5 and 1 respectively). The outside door handle 19 is connected directly to the lever mechanism 5.

Figure 1A:
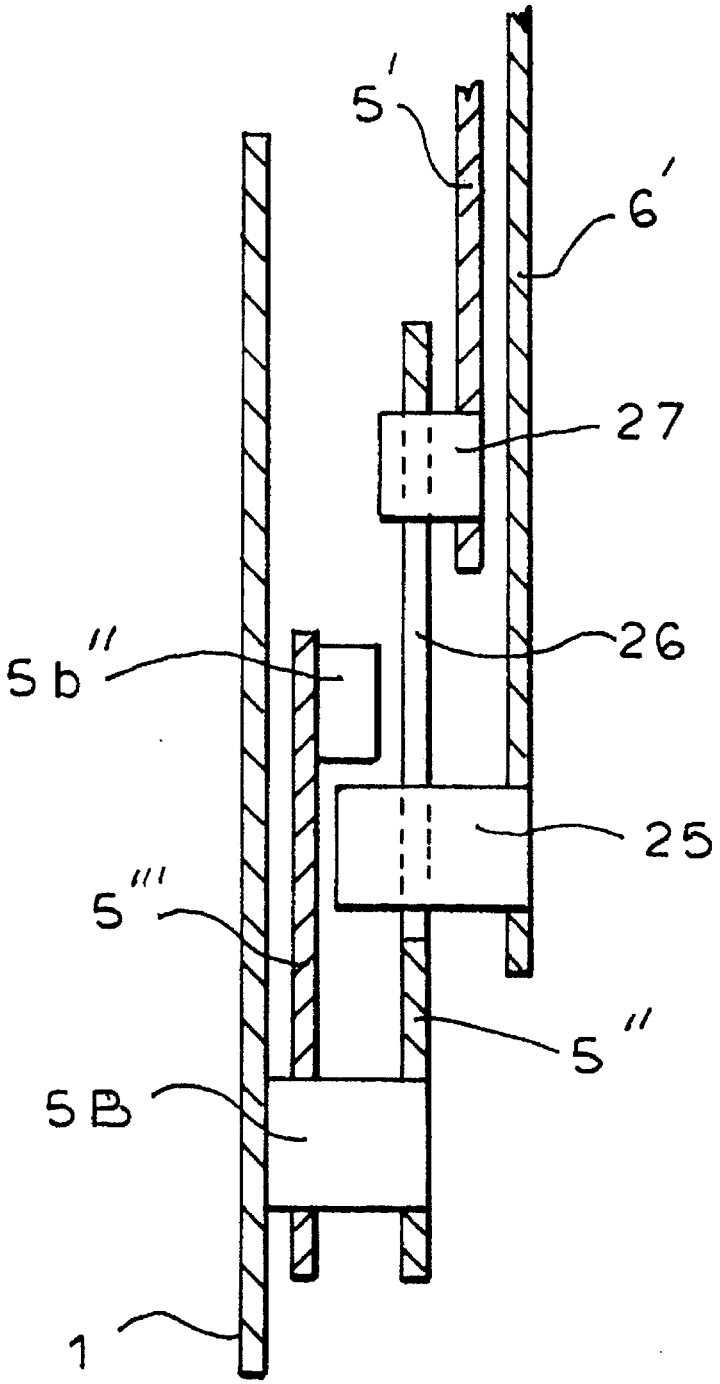
FIG. 1A is a section taken along line IA—IA of FIG. 1.

More particularly as shown in FIGS. 1 and 1A, the lever system 5 is formed of the levers 5', 5" pivoted on the housing 1 and a link 6' pivoted on the lever 6.

Lever 5" is pivoted at 5B on the housing 1 and formed with a radially extending slot 26 which serves as a guide for pins 25 and 27 described below. The sole function of the lever 5" is to guide the pins 25 and 27 and couple them together so that when the one pin 27, for example, moves, the other pin 25 will follow this movement.

The lever 5'" is pivoted on the axis 5B between the lever 5" and the housing 1 and has a tooth 5*a*" that can engage a pin 3' on the release pawl 3 and a tab 5*b*" that can be engaged by the pin 25. The pin 3' projects through a slot 1*a* in the housing 1.

The link 6' has a lower end in which is fixed the lower pin 25 that rides in the slot 26 and that can engage the tab 5*b*". The upper end of the link 6' is pivoted on the outer end of the lever 6 which is pivoted at 6A on the housing 1. This lever 6 is shown in FIG. 1 in the locked position in which its left-hand end is raised and right-hand end is lowered so that the link 6' is lowered and the pin 25 is below the tab 5*b*". It can be pivoted somewhat counterclockwise from this position to the position of FIG. 2 to unlock (not unlatch) the door into a position with the pin raised and engageable with the tab 5*b*".

The lever 5' is L-shaped and is pivoted at 5A on the housing 1. It has an upper arm operable by the lever 11 and a lower arm provided with the upper pin 27 riding in the slot 26 above the pin 25. When the lever is raised to unlatch the door, the lever 5' is pivoted clockwise about the axis 5A. The pin 27 couples the lever 5" to the lever 5' for joint pivoting, albeit about different axes in different directions, so that this movement will also push the other pin 25 in the slot 26 toward the left. If the pin 25 is in the lower locked position of FIG. 1, such pivoting of the opening lever 5' will have no effect on the pawl 3 as the pin 25 will pass underneath the tab 5*b*". If the pin 25 is raised into the unlocked position of FIG. 2, such pivoting will bring it into engagement with the right-facing side of the tab 5*b*" and will cause the pivoting of the lever 5" to be transmitted to the lever 5'" which will depress the release pawl 3 and release the fork 2.

Figure 6:
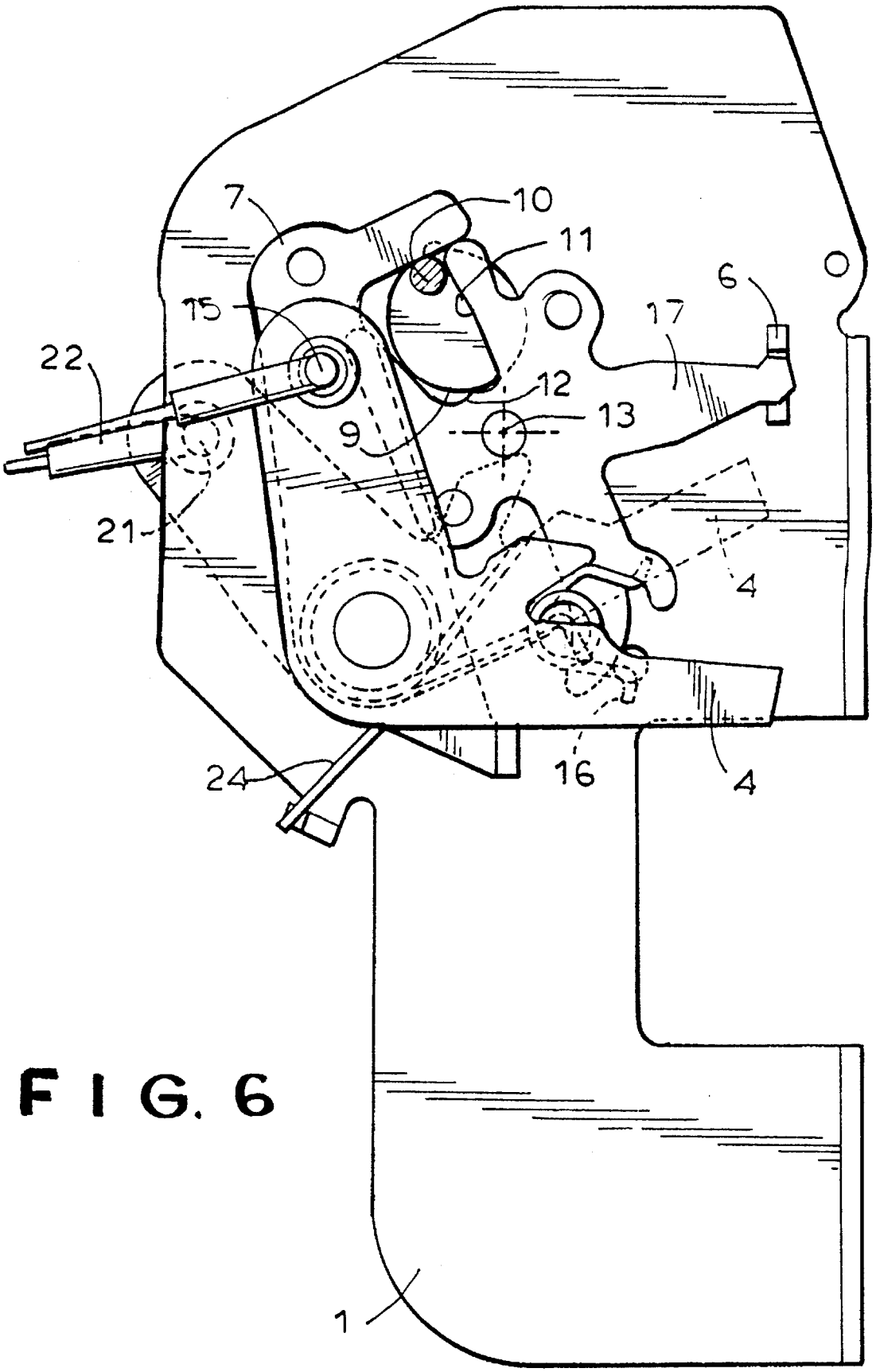

As seen in FIGS. 5 through 8, a two-arm cutout lever 7 pivoted centrally at an axis 15 can pivot between a decoupling position shown in FIGS. 6 and 7 and a coupling position shown in FIGS. 5 and 8. This lever 7 is provided with a pivot 20 defining a secondary axis and carrying an L-shaped two-arm inside latching lever 4. One arm of this lever 4 is provided with an attachment 21 connected via a bowden cable 22 or rod to the inside door handle 18 and its other arm can act on the lever mechanism 5 to unlatch the door. A spring 24 biases the lever 4 into the unactuated position.

If the lever 7 is in the decoupling position (FIGS. 5 and 8) the inside latching lever 4 cannot actuate the lever 5. Even if pulled back by the handle 18, the lever 4 is positioned so that it cannot move the lever mechanism 5 enough to release the pawl 3 from the fork 2. Thus operation of the inside handle 18 will not unlatch the door. On the other hand in the coupling position (FIGS. 6 and 7) actuation of the lever 4 is effective on the lever mechanism 5 to unlatch the door.

The attachment location 21 of the inside-handle link 22 is directly aligned in the unactuated position of the lever 4 with the pivot 15 of the lever 7 so that displacement of the lever 7 between its positions will not change the position of this attachment 21, thereby having no effect on the linkage 22.

The structure described above corresponds generally to that of commonly owned application 08/184,247 filed 18 Jan. 1994.

In accordance with the instant invention a reversible electric motor 23 is connected to a drive element 9 rotatable about drive axis 9A and having as seen in FIGS. 4*a* through 8 an eccentric pin or crank 10 that can act on the actuating lever 11 coupled to the lever 6 and also on an arm 14 of the lever 7. This actuating lever or drive element 11 is pivoted at an element axis 13 on the housing 1 and is formed with a notch 12 in which the eccentric 10 moves. A toggle spring 16 braced between the lever 11 and the housing 1 defines for the lever 11 an unlocked position shown in FIGS. 5 and 6 and a locked position shown in FIGS. 7 and 8.

The system described functions as follows as shown in FIGS. 4*a* through 10:

As seen in FIGS. 4*a* and 5, the eccentric 10 is engaged against one flank of the notch 12, whose angular width is at least twice the diameter of the eccentric 10, but is out of engagement with the arm 14 of the lever 7. Thus the lever 11 pushes down the lever 6 by means of its arm 17 and locks the door by decoupling the levers 5' and 5" from each other as described above. The lever 7 is however in the normal or coupled position so that the inside door handle 18 can act through the lever 4 on the locking lever 5'. The actuated position of the lever 4 is shown in FIGS. 5–8 in dot-dash lines. A pin 28 carried on the lever 11 cannot coact with an arm 29 of the lever 4 for automatic unlocking of the latch.

FIGS. 4*b* and 6 show how when the eccentric pin 10 is pivoted further to raise the arm 14 the door remains locked, but the lever 7 is moved into the decoupled position so that the inside door handle 18 becomes ineffective. This is useful both for cutout and antitheft protection, since in this mode—with the door locked and the inside handle disconnected—the requirements of both of these systems are met. The pin 28 and arm 29 can coact for automatic unlatching.

FIGS. 4*c* and 7 show pin 10 pivoted further to maintain the arm 14 up, with the inside handle 18 cut out, but with the lever 11 pivoted over to raise the lever 6 and unlock the door. Thus in this position the door can be unlocked by the outside door handle, but not by the inside one, at least not on the first actuation of the latter.

FIGS. 4*d* and 8 show the pin 10 further in its orbit in the position with the arm 14 lowered and the lever 11 in the unlocked position. Thus the door can be unlatched from both the inside and outside.

FIGS. 9 and 10 indicate how the pin 10 can be orbited in either direction from any position. It is therefore possible for the centrally controlled motor 23 to switch the respective lock between the lock between, for instance, the latched and unlatched position while leaving the inside handle in the coupled or decoupled position, whichever it is in. Alternately without affecting whether the door is locked or unlocked, the inside handle can be connected in or cut out. This is all done by a single operating element 10.

I claim:

1. A motor-vehicle door latch comprising:

a housing;

a lock fork on the housing engageable with a door bolt and pivotable between a locked position engaged around the bolt and retaining it on the housing and an unlocked position permitting the door bolt to move into and out of the housing;

a release pawl engageable with the fork and displaceable between a holding position retaining the fork in the locked position and a freeing position unengageable with the fork and permitting the fork to move into the unlocked position;

means including a lever mechanism connected to the release pawl and movable between an actuated position displacing the release pawl into the freeing position and an unactuated position with the release pawl in the holding position;

means including a locking element pivoted on the housing about an element axis, operatively connected to the lever mechanism, formed with an outwardly open notch of predetermined angular width, and displaceable between locked and unlocked positions for decoupling the lever mechanism from the release pawl in the locked position of the locking element and for coupling the lever mechanism to the release pawl in the unlocked position of the locking element;

a cutout lever pivotable on the housing about a cutout axis between a cutout position and a normal position;

a drive body rotatable about a drive axis parallel to the element and cutout axes and having an eccentric pin extending parallel to the axes and of a diameter equal to at most half of the width of the notch, the pin being engaged in the notch and being engageable with the cutout lever;

an inside handle operable from inside the vehicle;

an inside latching lever permanently connected to the inside handle for actuation thereby, operatively connected to the cutout lever, and having an end engageable with the mechanism to actuate same only in the normal position of the cutout lever and operatively unengageable with the mechanism in the cutout position of the cutout lever; and means including a motor for rotating the drive body and thereby orbiting the pin about the drive axis for displacing the cutout lever between the cutout and normal positions, and displacing the locking element between the locked and unlocked positions.

2. The motor-vehicle door latch defined in claim 1 wherein cutout lever and locking element are displaceable between the respective positions independently of each other.

3. The motor-vehicle door latch defined in claim 1 wherein the locking element, cutout lever, drive body, and inside locking lever are pivotable about respective parallel axes on the housing.

* * * * *